US006430899B1

(12) United States Patent
Cicha

(10) Patent No.: US 6,430,899 B1
(45) Date of Patent: Aug. 13, 2002

(54) TOP SEALING AND CREASING APPARATUS AND METHOD FOR A GABLE TOP CARTON

(75) Inventor: John Cicha, Shoreview, MN (US)

(73) Assignee: Tetra Laval Holdings & Finance, SA, Pully (CH)

( * ) Notice: Subject to any disclaimer, the term of this patent is extended or adjusted under 35 U.S.C. 154(b) by 181 days.

(21) Appl. No.: 09/591,314

(22) Filed: Jun. 9, 2000

(51) Int. Cl.[7] ..... B31B 1/36

(52) U.S. Cl. ..... 53/477; 53/371.2; 493/165; 493/183; 493/184

(58) Field of Search ..... 53/447, 484, 133.2, 53/300, 370.7, 371.2, 387.4, 467; 493/70, 165, 170, 183, 184

(56) References Cited

U.S. PATENT DOCUMENTS 4,251,303 A * 2/1981 Deimel et al. ..... 156/73.1
5,564,255 A 10/1996 Giacomelli
5,588,279 A 12/1996 Runnberg et al.
5,714,033 A 2/1998 Hayashi et al.
5,809,743 A 9/1998 Ylonen et al.
5,890,347 A 4/1999 Giacomelli et al.
6,000,195 A 12/1999 Jakobsson
6,012,267 A 1/2000 Katsumata
6,357,203 B1 * 3/2002 Cicha et al. ..... 53/370.6

* cited by examiner

*Primary Examiner*—John Paradiso
(74) *Attorney, Agent, or Firm*—Welsh & Katz, Ltd.

(57) ABSTRACT

A top sealer for a form, fill and seal packaging machine includes first and second anvils disposed on opposing sides of a processing path of the machine. The anvils are configured to move transverse to the processing path for engaging the top fins of each of the cartons and compressing the fins for forming the carton top seal portion. A first wedge section is mounted to the first anvil and a second wedge section is mounted to the second anvil. The first wedge section includes a raised portion extending from a face of the wedge. The first wedge is mounted to the anvil to contact the raised portion with a first vertical panel/extended gable panel juncture contemporaneous with the anvils engaging the top fins. Contact of the raised portion with the first vertical panel/extended gable panel juncture forms a crease at that juncture. A method for forming a top seal at the fin panels and a crease at the juncture is also disclosed.

16 Claims, 3 Drawing Sheets

TOP SEALING AND CREASING APPARATUS AND METHOD FOR A GABLE TOP CARTON

FIELD OF THE INVENTION

This invention is directed to an apparatus and method for sealing the fin of a gable-top carton. More specifically, the invention pertains to a top sealer jaw assembly for sealing and creasing the gable panels and fin of a gable top carton, and a method therefor.

BACKGROUND OF THE INVENTION

Gable top cartons are in widespread use. Such cartons have been known for most of the twentieth century. The characteristic simplicity and widespread acceptance have helped to maintain their popularity as cartons for traditional products, such as liquid food products, for example, milk and juice.

In the early, tradition gable top carton, access to the contained product was facilitated by opening a portion or one side of the gable so as to form a spout from the carton material. While this configuration was and still is widely accepted, one drawback is that resealability of the carton is limited. That is, while the gable can be "refolded" to close the carton, actual sealing (to reduce exposure to the environment, e.g., oxygen), is quite limited. To this end, improvements to such gable top cartons are ongoing.

In once such improvement, access to the product is provided by a spout that is integrally sealed to one of the gable panels. In a "conventional" spout arrangement, an opening is formed in the gable panel and a plastic or like spout is welded or sealed to the panel. A cap, such as a threaded closure is fitted onto the spout to provide resealability of the container. Such spouts have come into widespread use and acceptance for their ease of access to the product and their ability to help maintain product freshness.

In still further enhancements to the gable top cartons, it has been found that it is desirable to provide an extended gable or top panel to permit the use of larger spouts. This is particularly true for more viscous or solids-containing products. Due to the nature of these extended top panels, it has been found that the typical forming and sealing arrangements for creasing and forming the top fin and the extended gable panel do produce the desired configuration vis-à-vis fin angles and creases.

Accordingly, there exists a need for improved top sealer configurations for use with gable top carton designs. Desirably, such top sealer enhancements permit the forming of high quality gable top carton fin or top panel seals. Most desirably, such top sealer enhancements further provide well defined creases and folds for these novel extended panel configurations.

SUMMARY OF THE INVENTION

A top sealer for a form, fill and seal packaging machine for forming, filling and sealing a gable top carton provides a top seal portion and a clean, distinct crease at the vertical panel/gable panel juncture. The packaging machine defines a processing path along which the cartons are conveyed. The top sealer is disposed after a filling station along the machine processing path.

The gable top cartons include a vertical panel (e.g., a front wall panel) and at least one gable panel contiguous with the vertical panel. The panels define a vertical panel/gable panel juncture. The cartons further include top fins that define a top seal portion of the carton. In one arrangement, the cartons include an extended gable panel and a shorter, secondary gable panel.

The sealer includes first and second anvils disposed on opposing sides of the processing path. The anvils are configured to move transverse to the processing path to engage the top fins and compress the fins to form the top seal.

A wedge is mounted to at least one anvil, and preferably to both anvils. One of the wedges has one or more raised portions extending from a face of the wedge. The wedge is mounted to the anvil so that the raised portions contact the vertical panel/gable panel juncture contemporaneous with the anvils engaging the top fins. Contact of the raised portion with the vertical panel/gable panel juncture forms a clean, distinct crease at the juncture.

In one embodiment, the wedge defines a face having a planar portion or face and the raised portion extends from the planar face. The top sealer can include a plurality of wedges mounted to one of the anvils. In this configuration, some of the wedges can include raised portions and others of the wedges can include only planar face portions. Preferably, about one-half of the wedges include raised portions.

A method for forming a top seal on a gable top carton and for creasing a gable panel/vertical panel juncture includes providing first and second anvils disposed on opposing sides of the processing path, mounting a first wedge section to the first anvil and mounting a second wedge section to the second anvil. The first wedge section includes at least one wedge having a raised portion extending from a face of the wedge.

The method further includes transversely moving the anvils toward one another to engage the top fin panels of the carton and to compress the fins for forming the top seal portion of the carton. Contemporaneous with engaging the top fins, the method includes contacting the first wedge raised portion to the vertical panel/gable panel juncture to form a crease at that juncture.

In a preferred method, the anvils and wedges engage the top fin panels at least twice. Most preferably, the first wedge section raised portion contacts the carton at the vertical panel/gable panel juncture in a second or subsequent engagement of the anvils with the top fin panels.

These and other features and advantages of the present invention will be apparent from the following detailed description, the accompanying drawings, and the appended claims.

DETAILED DESCRIPTION OF THE PREFERRED EMBODIMENTS

Figure 1:
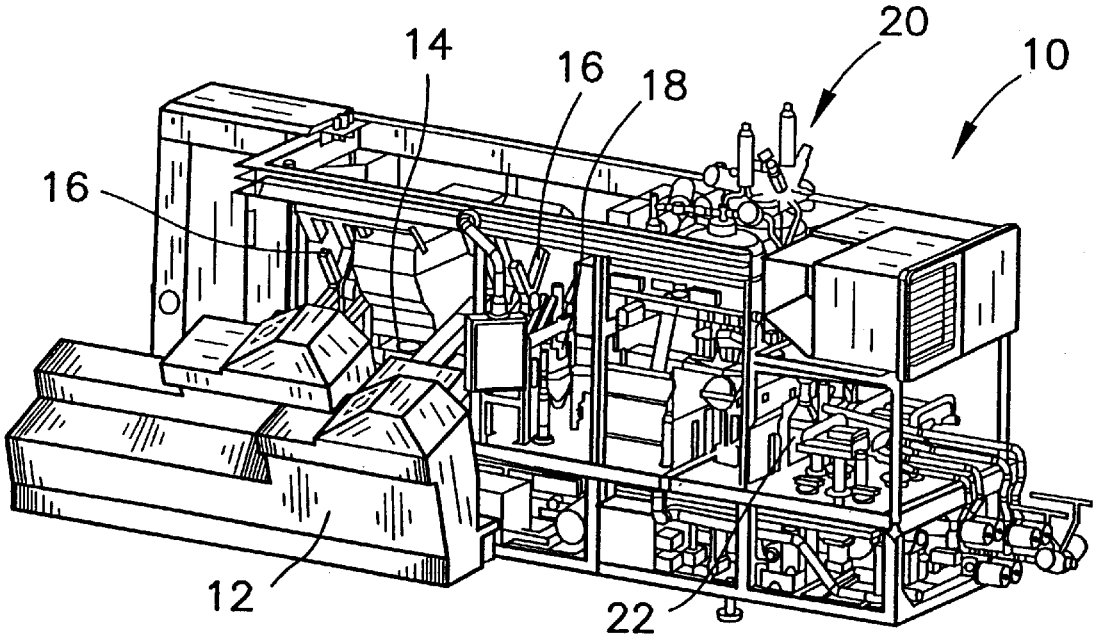
FIG. 1 is a perspective view of an exemplary form, fill and seal packaging machine having a top sealing apparatus for forming and sealing the top fin of a gable top carton embodying the principles of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures an in particular to FIG. 1, there is shown a conventional form, fill and seal packaging machine 10. One example of a packaging machine is disclosed in U.S. Pat. No. 6,012,267 to Katsumata which patent is incorporated herein by reference. The packaging machine 10 includes a carton magazine 12 for storing flat, folded carton blanks, a carton erection station 14 and a bottom forming and sealing station 16. The machine 10 can further include a sterilization station 18 for sterilizing the cartons and further includes a filling station 20 at which the cartons are filled with product. Following the filling station 20, the cartons' top panels are pre-folded and subsequently folded and sealed. The cartons are then off loaded from the form, fill and seal packaging machine 10.

The top sealing station, which is illustrated generally at 22, (more than one sealing station can be present on the packaging machine) includes opposing presses or anvils 24, 26 that engage one another on opposing sides of the top fin portion of the carton to form a substantially gas and liquid impermeable seal at the top fin.

Figure 6A:
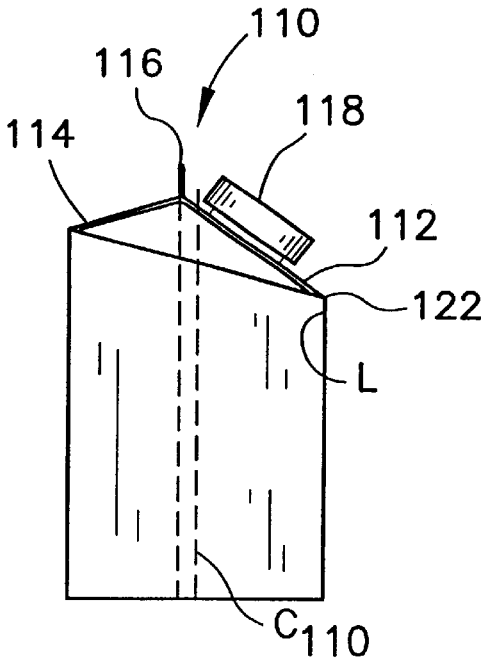
FIGS. 6*a* and 6*b* are side views of cartons having an extended top panel, which cartons are formed having clean, distinct crease lines using the present top sealer apparatus and method.
Figure 6B:
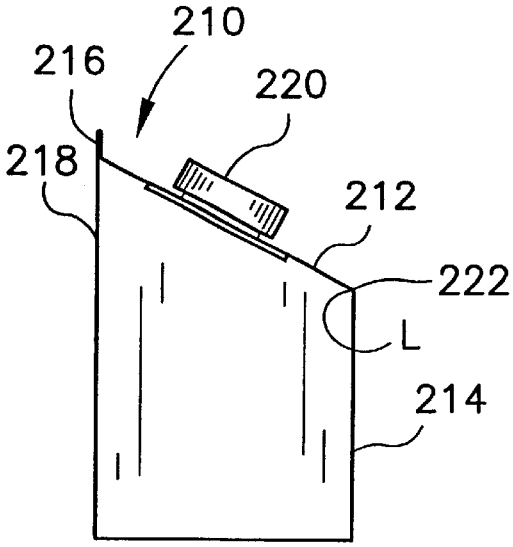

As discussed above, enhancements in the design of gable top cartons have been ongoing. In one such enhancement, the conventional gable panels of a gable top carton are replaced by "extended" top panels. In such an arrangement, one of the gable panels is extended or elongated. Examples of these extended top panel cartons are illustrated in FIGS. 6*a* and 6*b*. As can be seen from these drawings, in one carton configuration 110, as seen in FIG. 6*a*, the carton includes one extended panel 112 and one shorter panel 114, which panels meet at the top fin portion 116. The top fin 116 appears as would the top fin of a standard gable top carton, except that the fin 116 is offset from a centerline $C_{110}$ of the carton 110. The carton 110 can be fitted with a resealable closure 118. In another embodiment of the extended top panel carton 210 shown in FIG. 6*b*, the carton includes a single extended top 212 panel rising from the front wall 214 and forming the fin 216 with a portion of the rear wall 218 of the carton 210. This carton 210 can also include a resealable closure 220. In both of these embodiments of the extended top panel carton 110, 210, the carton configuration provides a rather distinct aesthetic appeal as well as an extended or elongated panel 112, 212 to, for example, accommodate an oversized spout, closure, cap or the like.

Figure 2:
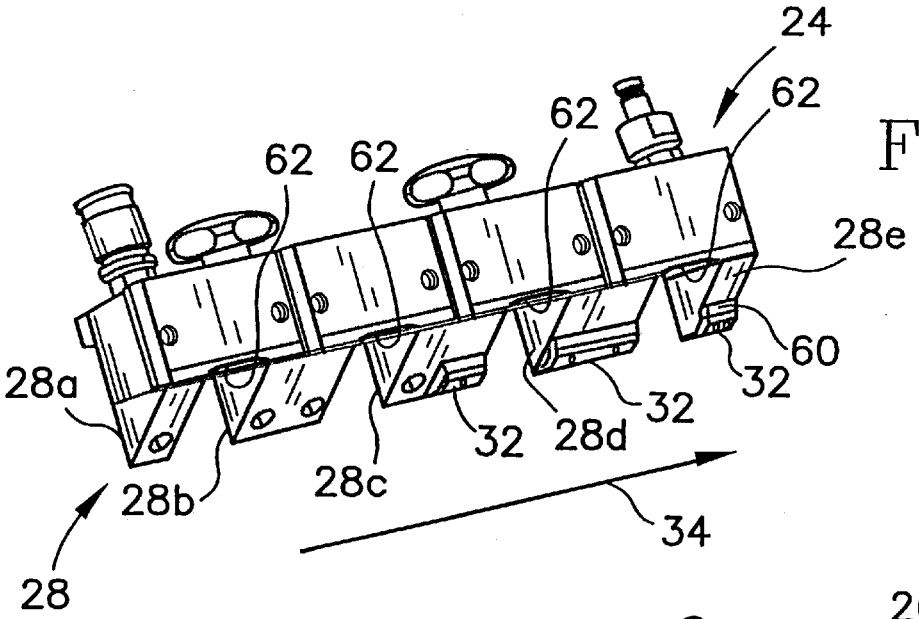
FIG. 2 is a perspective view of an sealer anvil portion of the sealing apparatus illustrating both planar and raised wedges.
Figure 3:
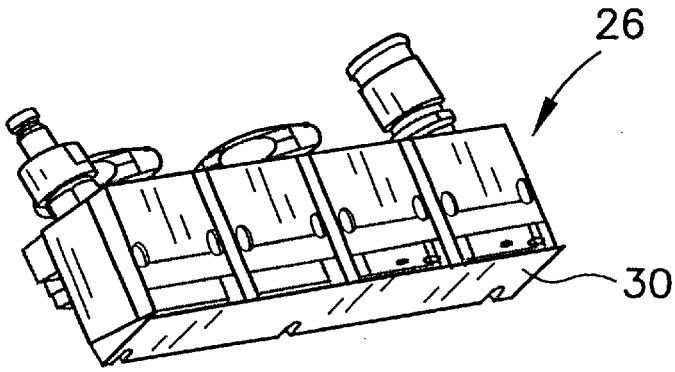
FIG. 3 is a perspective view of the non-raised wedges of the opposing sealer anvil portion.
Figure 4:
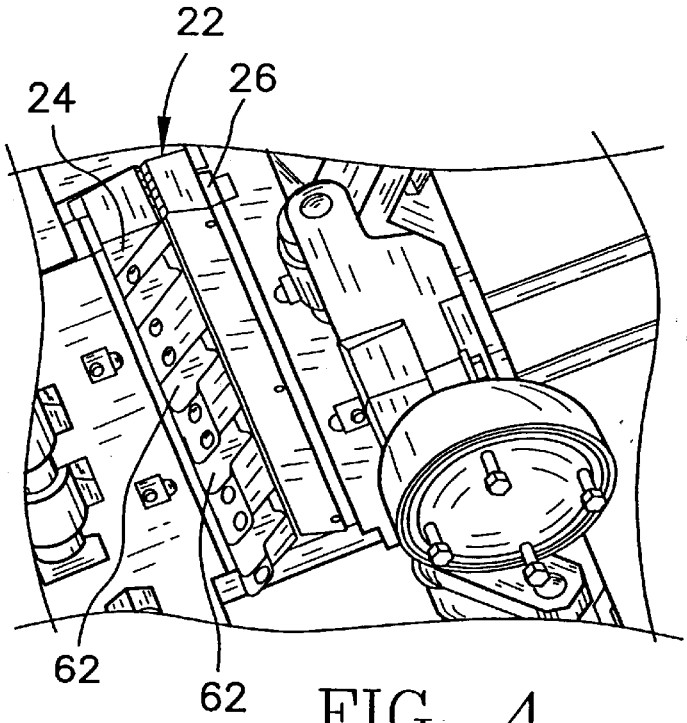
FIG. 4 is a bottom perspective view, looking into the sealer, illustrating the opposing, asymmetrical wedges.
Figure 5:
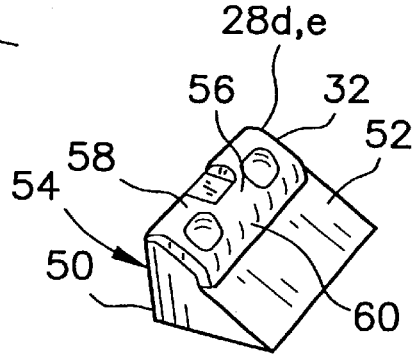
FIG. 5 is a perspective view of one raised portion wedge.

Referring to FIGS. 2 and 3, a plurality of wedges 28*a–e* (collectively 28) are mounted to one of the anvils 24, while a single wedge 30 is mounted to the other anvil 26. The anvils 24, 26 are configured to directly contact the top fin 116, 216, while the wedges 28, 30 are configured to contact at least some of the top gable panels 112, 114 and 214 to form clean, distinct creases L at the carton fold lines. Unlike known configurations in which the wedges have substantially flat, planar surfaces, in the present invention, some of the wedges (part of 28*c* and 28*d–e*) include raised sections 32 that extend longitudinally along at least a portion of the length of the wedge 28*c–e* in the direction of travel of a carton through the top sealer 22, which direction is indicated in FIG. 2 by the arrow at 34.

Figure 7:
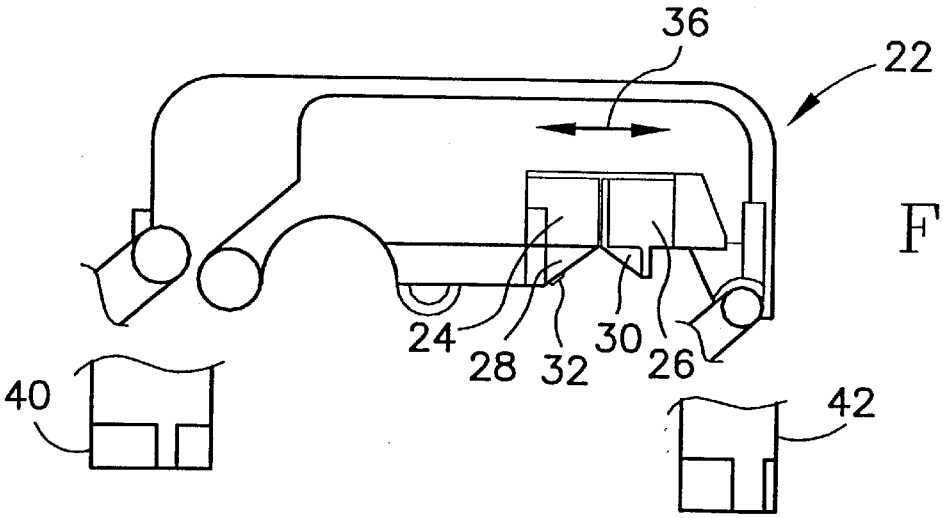
FIG. 7 is an illustration of the sealer station of an exemplary packaging machine with the sealer anvil portions engaged with one another, with the carton removed from between the anvil portions for clarity of illustration.
Figure 8:
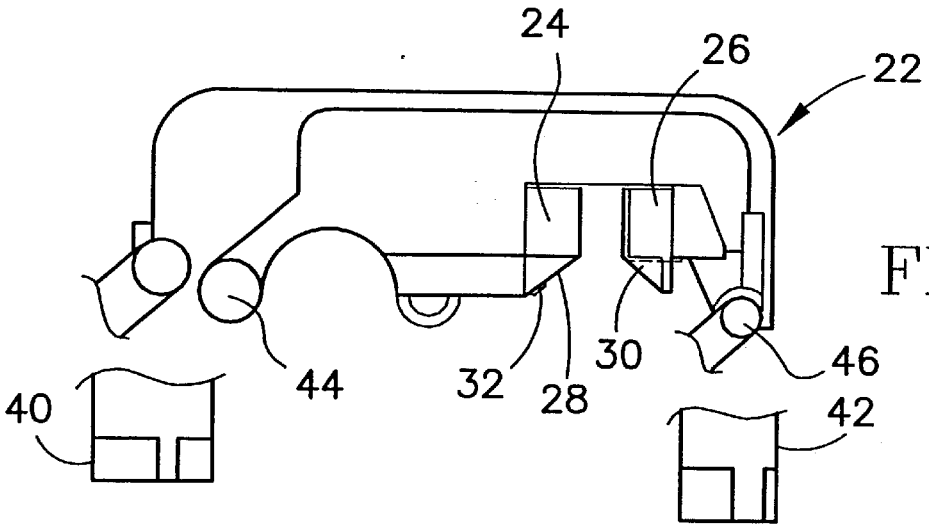
FIG. 8 is a view similar to FIG. 7 showing the anvil portions spaced from one another ready for receipt of a carton.
Figure 9:
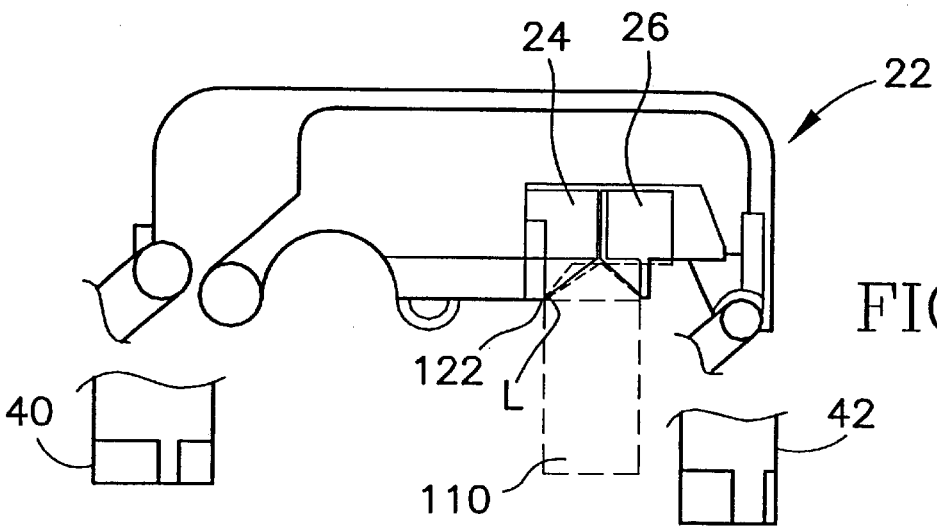
FIG. 9 is a view similar to FIG. 7 shown with a carton, in phantom lines having its top fin panels between the sealer anvil portions.

Referring now to FIGS. 7–9, the anvils 24, 26 are mounted within the sealing station 22 to move laterally, as indicated by the double-headed arrow at 36, relative to the longitudinal movement of the cartons through the processing path. The anvils 24, 26 reciprocate, in a generally straight-line path, to engage and release the cartons as they traverse through the sealing station 22.

The anvils 24, 26 are driven in a reciprocating manner by one or more drives, such as the exemplary drives 40, 42, which are operably connected to the anvils 24, 26 by one or more mechanical linkages 44, 46. Those skilled in the art will appreciate and understand the various drive arrangements that can be used for the anvils 24, 26, such drives including, but not limited to hydraulic, pneumatic, electromechanical and electrical drives. All such drives are within the scope and spirit of the present invention.

The wedges 28, 30 are configured to engage a portion of the gable panel 112, 212 at about a juncture of the gable panel and a vertical panel (e.g., front or side wall) of the carton as indicated at 122, 222. As discussed above, in that some types of enhanced gable top designs include an extended top panel, such as those illustrated in FIGS. 6*a* and 6*b*, it has been found that the standard wedges do not sufficiently contact the gable panel at the gable front (or side) wall juncture to form a clean or distinct crease line L. Rather, it has been found that standard, non-raised wedges often result in a bulge or curved area along the crease line at this juncture, rather than the desired clean, distinct crease.

As can be seen from the figures, the wedges 28 of the present top sealer 22 include a main body portion 50 having a recessed, generally planar region 52. Some of the wedges 28*d–e* and a portion of 28*c*, include the raised portions, which are disposed at a lower region 54 of the wedges 28*c–e* and extend outwardly from the planar face 52. The raised portions 32 can, likewise, include a generally planar surface 56 that is parallel to, and spaced from the planar region 52. Sloped or angled intermediate faces 58, 60 extend between the main body 50 and the raised portion face 56. Gaps, as indicated at 62 are defined by the spacing between the wedges along the side of the carton path on which the spout travels, to accommodate the spout or like closure assembly that can extend upwardly from the gable panel 112, 212. The wedges 28, 30 are secured to the anvils 24, 26 by aligning pins and bolts (not shown) to permit ready replacement and maintenance.

Referring to FIG. 9, it can be seen that as the anvils 24, 26 of the top sealer 22 engage one another, the raised portions 32 of the wedges 28*c–e* contact the gable panel 112, 212 at about the gable/front wall juncture 122, 222. As the wedges 28*a–e* engage the carton at the panel juncture 122, 222, they urge the carton inwardly and downwardly so as to create a clean, distinct crease line L. It has been observed that standard wedges, when used with these extended top panel cartons, result in bulges or rounded corners at the creases. As will be appreciated by those skilled in the art, these bulges or rounded corners can result in a visually unappealing product. Consumers that are unfamiliar with the mechanics of packaging and packaging machines, may believe that such packages are inferior to those having clean, distinct crease lines.

In a preferred method of forming and sealing the carton top fins 116, 216, the cartons 110, 210 traverse through the sealing station 22 and are first contacted, on both sides of the gable, by the wedge 30 and those wedges 28 having non raised (e.g., planar) portions (wedges 28*a–b* and a portion of wedge 28*c*). The cartons 110, 210 are then contacted in a subsequent engagement by wedge 30 and wedges 28*d–e* and a portion of wedge 28*c* having a raised section 32. In the first engagement of the wedges 30 and 28*a–c* with the top panels, the creases are formed and the gable panels are shaped, while at the same time, the fin 116, 216 is sealed by engagement of the anvils 24, 26 with one another and the fin panel. In the subsequent engagement of the wedges 30 and 28*c–e* with the gable panels, the raised portions 32 contact the carton 110, 210 at the gable/top panel juncture 122, 222 to provide a clean, distinct crease at the fold line L. Again, as the wedges 30 and 28*c–e* contact the carton 110, 210 in the subsequent engagement, the fin 116, 216 is further pressed by the anvil portions 24, 26 to further form the top fin seal.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A method for forming a top seal on a gable top carton and for creasing a gable panel/vertical panel juncture, the carton being conveyed along a processing path on a form, fill and seal packaging machine, the carton defining a plurality of top fin panels configured for sealing to one another to form a package top seal portion, method comprising the steps of:

providing first and second anvils disposed on opposing sides of the processing path, mounting a first wedge section to the first anvil, the first wedge section includes at least one raised portion extending from a face thereof;

mounting a second wedge section to the second anvil;

transversely moving the anvils toward one another to engage the top fin panels of the carton and to compress the fins for forming the top seal portion of the carton; and contacting the first wedge raised portion to the vertical panel/gable panel juncture contemporaneous with the anvils engaging the top fin panels, the raised portion of the wedge contacting the vertical panel/gable panel juncture to form a crease at the juncture.

2. The method for forming a top seal on a gable top carton in accordance with claim 1 wherein the anvils and wedges engage the top fin panels at least twice.

3. The method for forming a top seal on a gable top carton in accordance with claim 2 wherein in a second engagement of the anvils with the top fin panels, the first wedge section raised portion contacts the carton at the vertical panel/gable panel juncture.

4. The method for forming a top seal on a gable top carton in accordance with claim 3 wherein the first wedge section raised portion contacts the carton at the vertical panel/gable panel juncture only in the second engagement of the anvils with the top fin panels.

5. A top sealer for a form, fill and seal packaging machine for forming, filling and sealing a gable top carton, the machine defining a processing path, the top sealer disposed after a filling station along the machine, the gable top carton including a vertical panel, at least one gable panel contiguous with the vertical panel and defining a vertical panel/gable panel juncture and top fins, the top fins defining a top seal portion of the carton, the sealer comprising:

first and second anvils disposed on opposing sides of the processing path, the anvils configured to move transverse to the processing path for engaging the top fins and compressing the fins for forming a seal at the top fins; and a wedge mounted to at least one anvil, the wedge having a raised portion extending from a face thereof, the wedge mounted to the anvil for contacting the raised portion with the vertical panel/gable panel juncture contemporaneous with the anvils engaging top fins, the raised portion contacting to vertical panel/gable panel juncture to form a crease at the juncture.

6. The top sealer in accordance with claim 5 wherein the wedge face defines a planar portion and the raised portion extends from the planar face.

7. The top sealer in accordance with claim 5 including a plurality of wedges mounted to the at least one anvil.

8. The top sealer in accordance with claim 7 wherein at least one of the wedges includes the raised portion.

9. The top sealer in accordance with claim 7 wherein about one-half of the wedges include raised portions.

10. The top sealer in accordance with claim 9 wherein the wedges define a gap therebetween.

11. A top sealer for a form, fill and seal packaging machine for forming, filling and sealing a series of extended top panel gable top cartons, the machine defining a processing path, the top sealer disposed after a filling station along the machine, each of the series of gable top cartons including a first vertical panel and an extended gable panel contiguous with the first vertical panel, each of the series of cartons further defining a second vertical panel opposingly oriented to the first vertical panel and a secondary gable panel opposingly oriented to the extended gable panel and contiguous with the second vertical panel, each of the series of cartons defining a first vertical panel/extended gable panel juncture and top fins extending from the extended and secondary gable panels, the top fins configured for sealing to one another to define a top seal portion of each of the series of cartons, the sealer comprising:

first and second anvils disposed on opposing sides of the processing path, the anvils configured to move transverse to the processing path for engaging the top fins of each of the series of cartons and compressing the fins for forming the top seal portion of each of the series of cartons;

a first wedge section mounted to the first anvil; and a second wedge section mounted to the second anvil, wherein the first wedge section includes at least one raised portion extending from a face thereof, the first wedge mounted to the anvil to contact the at least one raised portion of each of the series of cartons with the first vertical panel/extended gable panel juncture contemporaneous with the anvils engaging the top fins, the at least one raised portion contacting the first vertical panel/extended gable panel juncture to form a crease at the juncture of each of the series of cartons, the second wedge section being configured to contact the second gable panel of each of the series of cartons.

12. The top sealer in accordance with claim 11 wherein the first wedge section includes a plurality of wedges, and wherein about one-half of the wedges include raised portions and another of the one-half of the wedges include planar faces.

13. The top sealer in accordance with claim 12 wherein the sealer is configured to engage each of the series of cartons at least twice, and wherein in a first engagement, each of the series of cartons is contacted by the first wedge planar faces and wherein in a subsequent engagement each of the series of cartons is engaged by a first wedge raised portion.

14. The top sealer in accordance with claim 12 wherein at least one of the wedges is formed having the raised portion extending along about one-half of a length of the wedge.

15. The top sealer in accordance with claim 14 wherein two of the wedges are formed having the raised portion extending along about one-half of the length of each of the two wedges.

16. The top sealer in accordance with claim 12 wherein the first wedge sections define gaps therebetween.

* * * * *